US006814411B1

(12) United States Patent
Lin

(10) Patent No.: US 6,814,411 B1
(45) Date of Patent: Nov. 9, 2004

(54) FIXING STRUCTURE OF AN ELECTRIC WHEELCHAIR SEAT

(75) Inventor: Samuel Lin, Chia Yi (TW)

(73) Assignee: Sunpex Technology Co., Ltd., Chia Yi (TW)

( * ) Notice: Subject to any disclaimer, the term of this patent is extended or adjusted under 35 U.S.C. 154(b) by 0 days.

(21) Appl. No.: 10/724,760

(22) Filed: Dec. 2, 2003

(51) Int. Cl.[7] ..... A47C 7/00
(52) U.S. Cl. ..... 297/440.22; 297/DIG. 4
(58) Field of Search ..... 297/440.22, DIG. 4; 248/503.1; 296/65.03

(56) References Cited

U.S. PATENT DOCUMENTS 3,915,493 A * 10/1975 Brown ..... 296/63
3,917,312 A * 11/1975 Rodaway ..... 280/250.1
4,805,952 A * 2/1989 Coleman ..... 296/65.03
4,967,864 A * 11/1990 Boyer et al. ..... 180/65.1
4,978,097 A * 12/1990 Froutzis ..... 248/503.1
5,326,067 A * 7/1994 Gonzalez ..... 248/503.1
5,496,088 A * 3/1996 Stewart ..... 296/65.03
5,593,211 A * 1/1997 Jay et al. ..... 297/383
2003/0151294 A1 * 8/2003 Glater ..... 297/440.22

* cited by examiner

*Primary Examiner*—Peter M. Cuomo
*Assistant Examiner*—Stephen D'Adamo
(74) *Attorney, Agent, or Firm*—Rosenberg, Klein & Lee

(57) ABSTRACT

An electric wheelchair includes a frame, and a seat; the frame has front and rear support rods projecting upwards from it, locating parts secured to the front support rods, and fitting parts secured to the rear support rods; each locating part has opposing guide trenches; each fitting part has lateral portions formed with opposing holes; the seat has engaging elements, and fitting elements secured to the lower side; each engaging element has a slide rod; each fitting element has opposing holes on lateral portions thereof; thus, the seat can be secured to the frame by means of passing pins through the holes of the fitting parts and the fitting elements after the slide rods are passed into the guide trenches, and after the holes of the fitting elements are aligned with the holes of the fitting parts.

3 Claims, 7 Drawing Sheets

FIXING STRUCTURE OF AN ELECTRIC WHEELCHAIR SEAT

BACKGROUND OF THE INVENTION

1. Field of the Invention

The present invention relates to an electric wheelchair, more particularly one whose seat is stable, and convenient to use.

2. Brief Description of the Prior Art

Referring to FIG. 7, a conventional electric wheelchair includes a main body 3, and a seat 4. The main body 3 is comprised of a frame 31, wheels 32 fitted to the frame 31, a shell (not shown) arranged around the frame 31, a transverse board 33 secured to the frame 31, an upright tube 35 projecting from the transverse board 33, and a straight rod 36 securely inserted in the upright tube 35. The seat 4 has a fitting post 41 projecting downwards virtually from a middle of a lower side thereof. A holding room 34 is provided in the frame 31 for holding a power supplying mechanism (not shown) therein. The straight rod 36 has an adjustment disk (not numbered), and an upright fitting hole 361, which has a slightly larger diameter than the fitting post 41 of the seat 4.

The fitting post 41 is inserted in the fitting hole 361 of the straight rod 36 for the seat 4 to be supported in position. However, the electric wheelchair is found to have the followings disadvantages:

1. In order for the seat 4 to be removable from the main body 3, there has to be a small space between the fitting post 41 and the straight rod 36 when the post 41 is inserted in the fitting hole 361. Consequently, the fitting post 41 and the fitting hole 361 are not co-axial, and the seat 4 is prone to shake when one is ridding on the wheelchair. Furthermore, the seat 4 is not stable and unsafe to use because it is only supported at the middle.
2. The seat 4 and the main body 3 have to be first separated such that the wheelchair can be transported with a car. Because of the fitting post 41, the seat 4 can't be put in a stable position lower side down when it is separate from the main body 3. Consequently, when the wheelchair is transported with a car, the seat 4 is prone to move around to get damaged, cause danger or damage to other objects in the trunk.

SUMMARY OF THE INVENTION

It is a main object of the present invention to provide an electric wheelchair whose seat is stable, and convenient to use.

The wheelchair of the present invention includes a frame, and a seat. The frame has front and rear upright support rods, locating parts secured to tops of the front support rods, and fitting parts secured to tops of the rear support rods. Each locating part has opposing guide trenches while each fitting part has lateral portions formed with opposing holes. The seat has front engaging elements, and rear fitting elements secured to the lower side thereof. Each engaging element has a slide rod while each fitting element has opposing holes on lateral portions thereof. The seat is detachably secured to the frame by means of passing pins through the holes of the fitting parts and the fitting elements after the slide rods are passed into the guide trenches, and after the holes of the fitting elements are aligned with the holes of the fitting parts.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
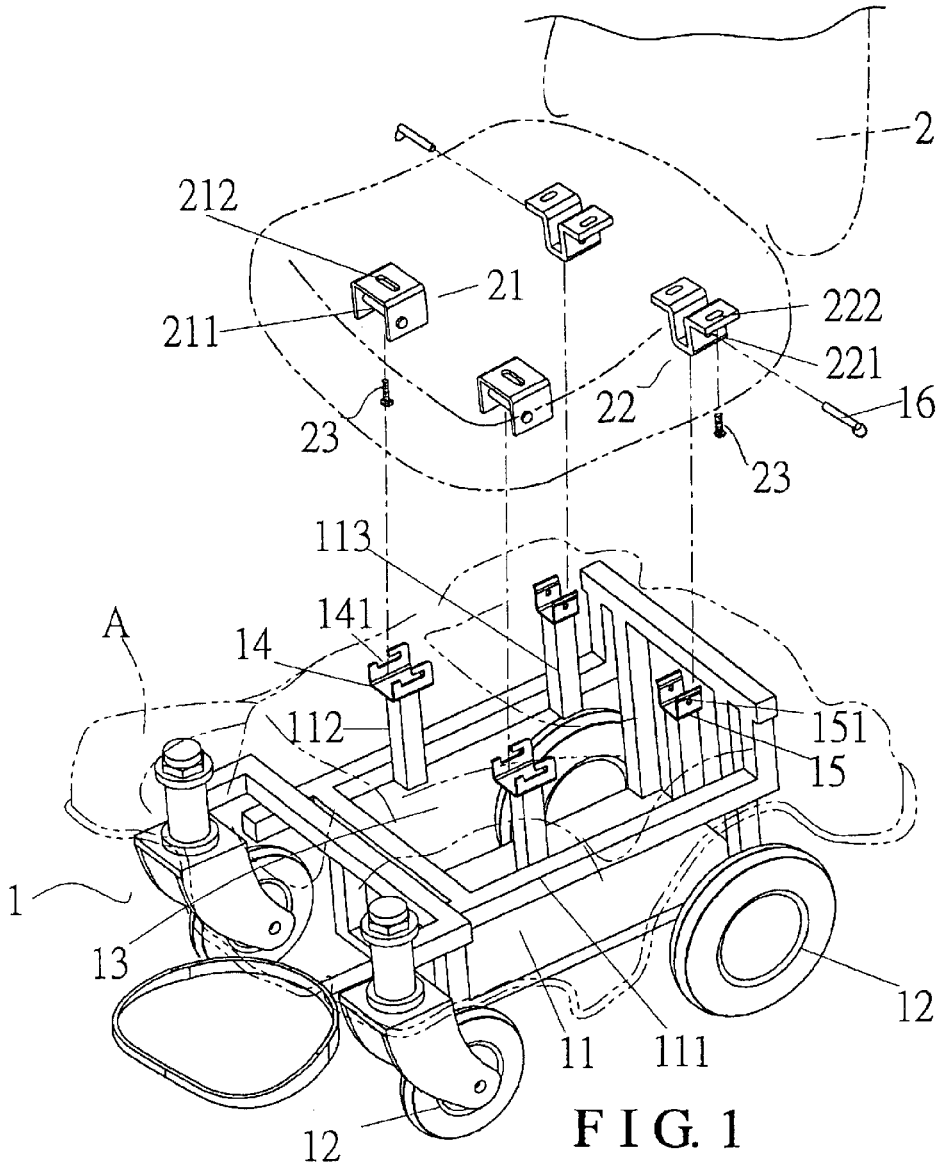
FIG. 1 is an exploded perspective view of the electric wheelchair according to the present invention.
Figure 2:
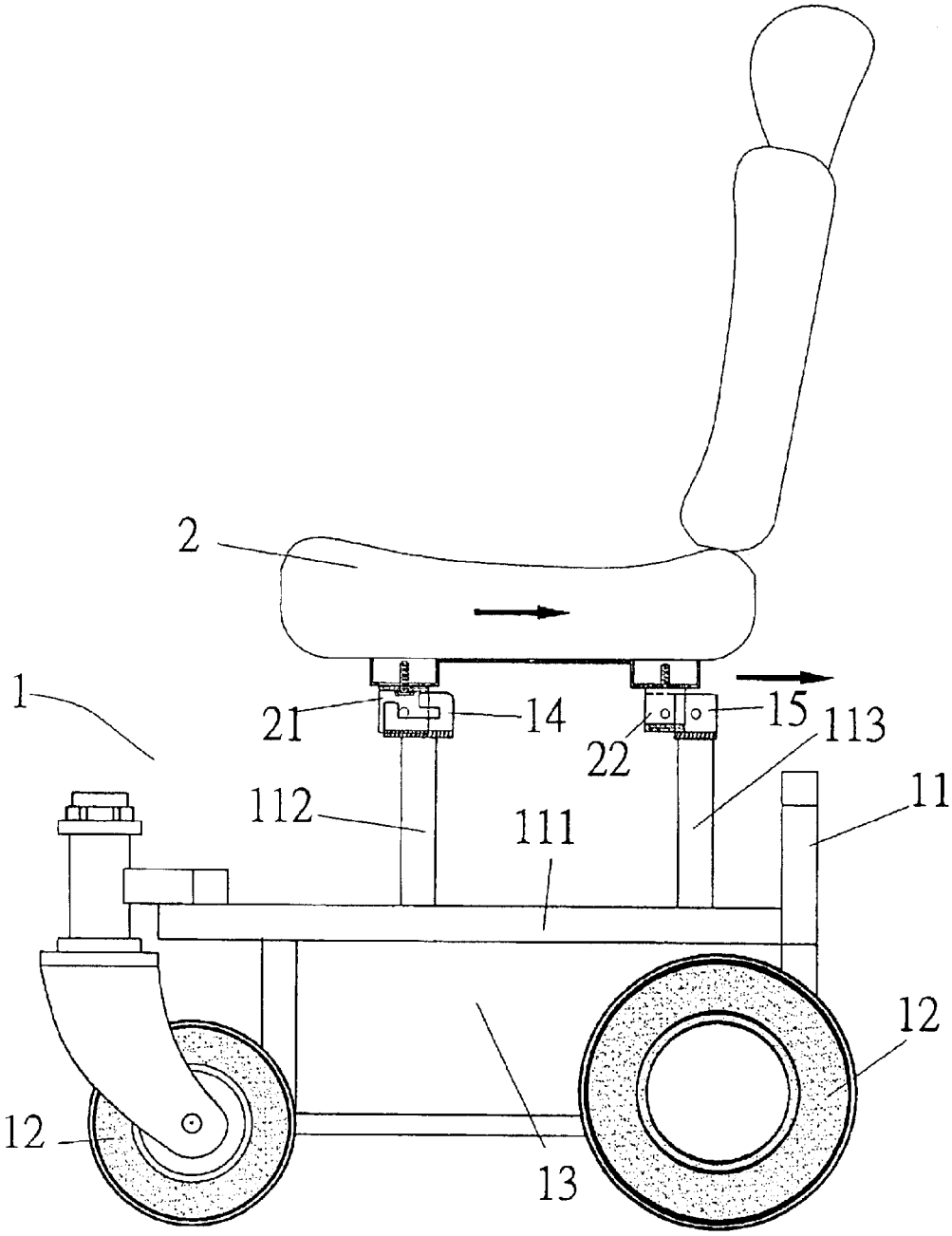
FIG. 2 is a cross-sectional view of the electric wheelchair of the present invention under assembly.
Figure 3:
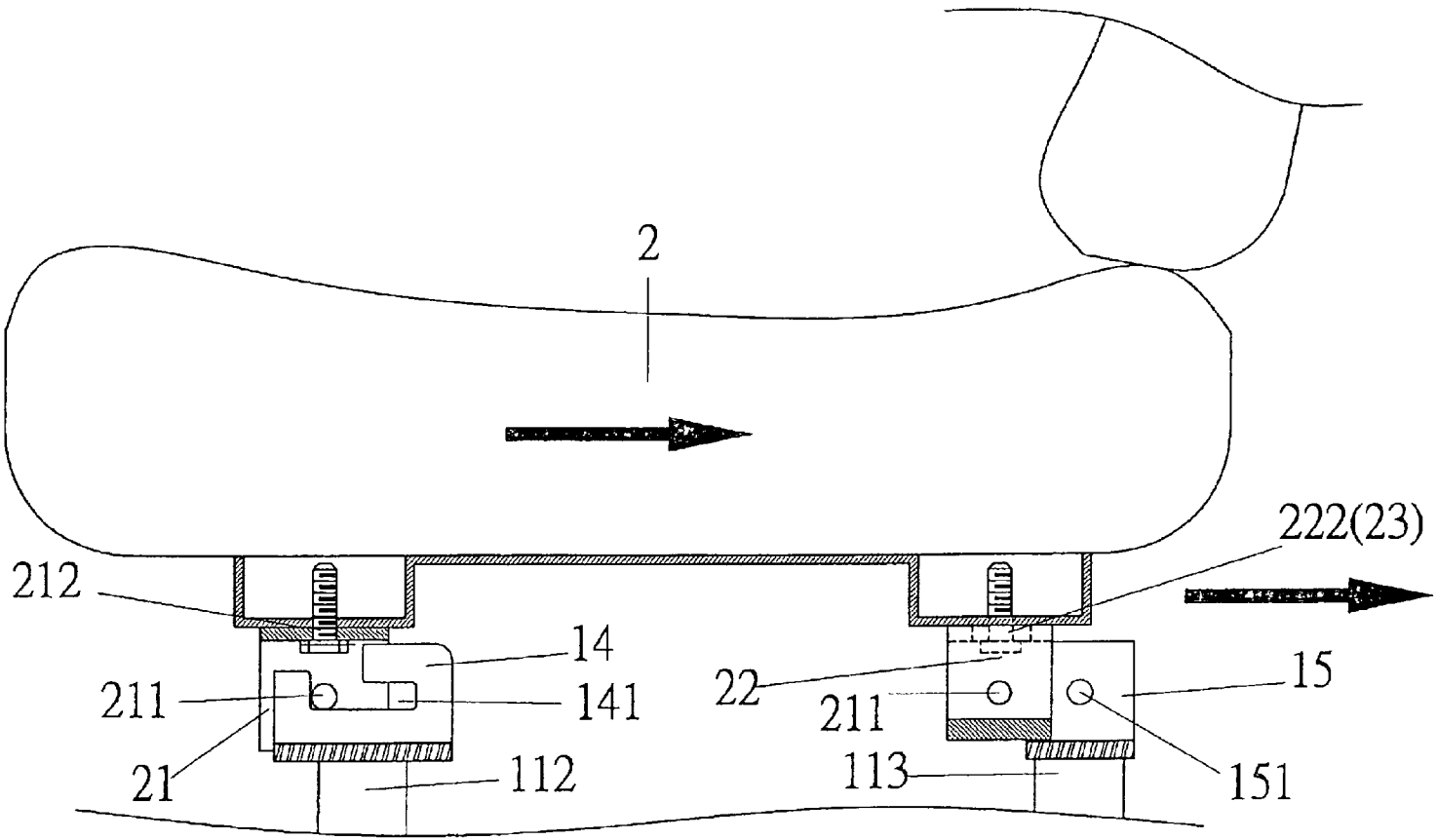
FIG. 3 is a partial enlarged view of FIG. 2.
Figure 4:
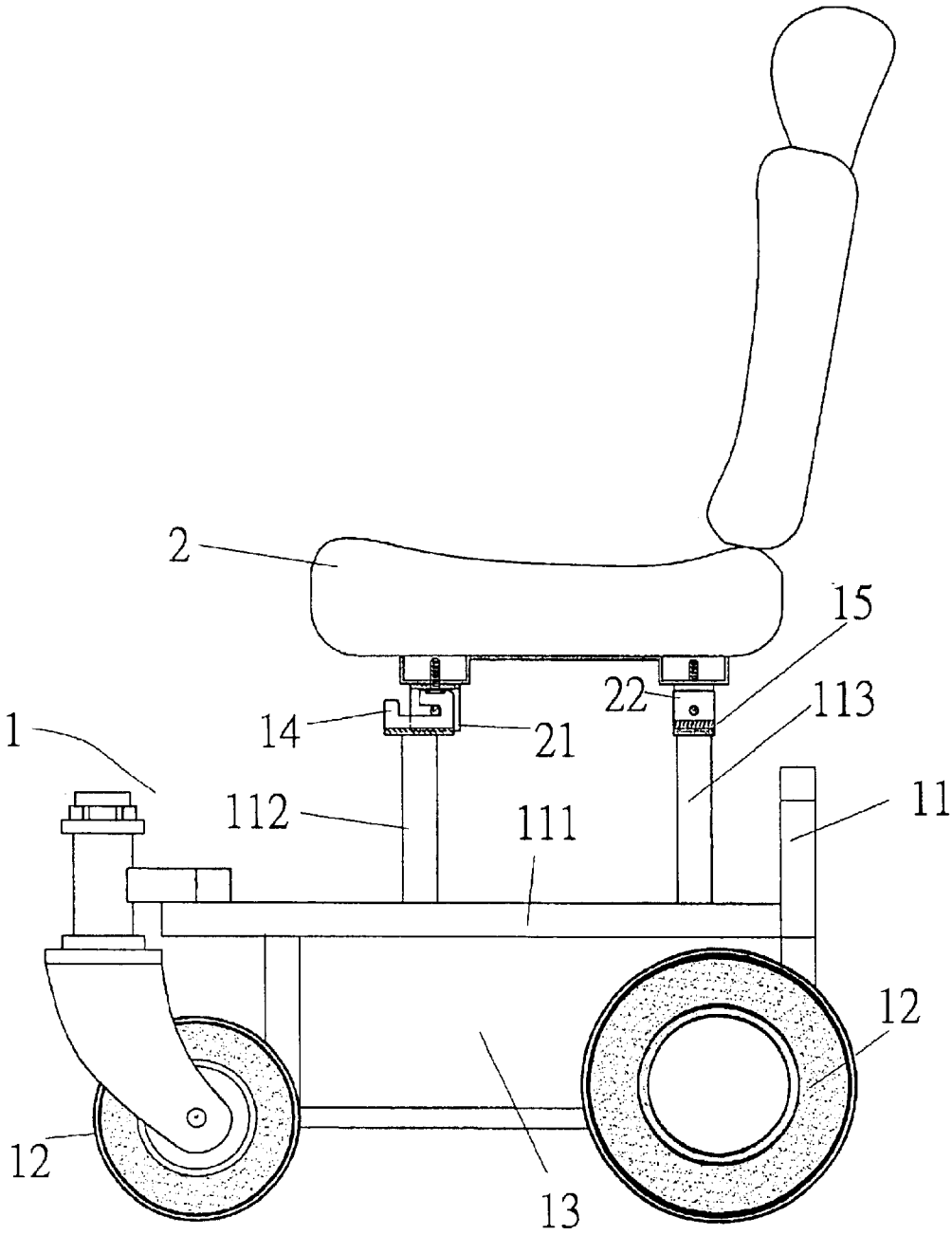
FIG. 4 is another cross-sectional view of the electric wheelchair of the present invention under assembly.
Figure 5:
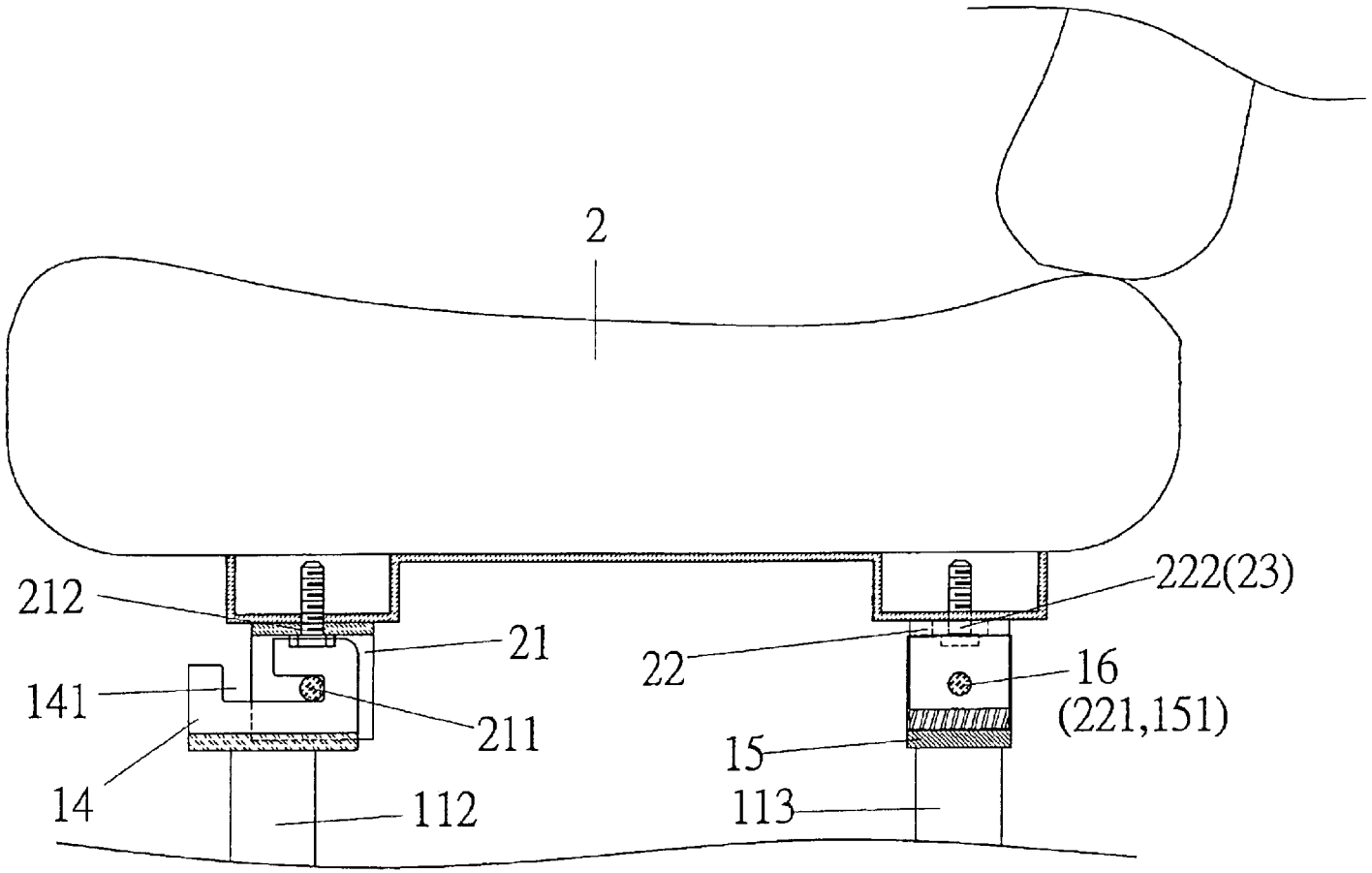
FIG. 5 is a partial enlarged view of FIG. 4.

Referring to FIG. 1, a preferred embodiment of an electric wheelchair in the present invention includes a main body 1, and a seat 2.

The main body 1 is comprised of a frame 11, wheels 12 fitted to the frame 11, a shell (A) arranged around the frame 11, and a holding room 13 for holding a power supplying mechanism (not shown) therein. The frame 11 has lateral rods 111, 111 on left and right sides, front support rods 112, 112 projecting upwards from front portions of the lateral rods 111, 111, and rear support rods 113, 113 projecting upwards from rear portions of the lateral rods 111, 111. Each of the front support rods 112 has a locating part 14 secured to a top thereof, which has two lateral portions formed with opposing guide trenches 141. Each of the rear support rods 113 has a fitting part 15 secured to a top thereof, which has two lateral portions formed with outwards-folded upper ends, and opposing through holes 151.

The seat 2 has two juxtaposed engaging elements 21, 21 secured to a front portion of a lower side thereof, and two juxtaposed fitting elements 22, 22 secured to a rear portion of a lower side thereof. Each engaging element 21 has an elongated securing hole 212 on an upper portion, two lateral portions, and a slide rod 211 connected to the lateral portions thereof at two ends; the engaging elements 21 are secured to the seat by means of threaded fixing elements 23 such as screws and bolts, which are passed through the elongated holes 212 and screwed into the seat 2. Each fitting element 22 has two lateral portions, opposed fitting holes 221 on the lateral portions thereof, and upper portions, which extend from upper ends of the lateral portions, and which are formed with elongated securing holes 222; the fitting elements 22 are secured to the seat by means of threaded fixing elements 23, which are passed through the elongated holes 222 and screwed into the seat 2. The engaging elements 21 and the fitting elements 22 can be adjusted in position relative to the seat 2 because the securing holes 212 and 222 are elongated.

Referring to FIGS. 2 to 5, in assembly, the slide rods 211 of the engaging elements 21 are passed into, and moved along the guide trenches 141 of a respective one of the locating parts 14, with the lateral portions of the fitting elements 22 being held in corresponding fitting parts 15, until the fitting holes 221 of the fitting elements 22 are aligned with the through holes 151 of the fitting parts 15. Then, pins 16 are inserted through the fitting holes 221 and the through holes 151. Thus, the slide rods 211 are engaged with the locating parts 14, and the fitting elements 22 securely connected to the fitting parts 15, and in turns, the seat 2 is securely supported on the frame 11.

To separate the seat 2 from the main body 1 for allowing the wheelchair to be transported with a car, one only has to first pull the pins 16 out of the holes 221 and 151, and then move the seat 2 so as to make the slide rods 211 disengage the locating parts 14.

From the above description, it can be easily understood that the electric wheelchair of the present invention has advantages as followings:

1. The seat 2 is very stable because it is secured in position at four points, i.e. the fitting elements 22 and the engaging elements 21. Therefore, one will feel steady and safe when ridding on the wheelchair.

Figure 6:
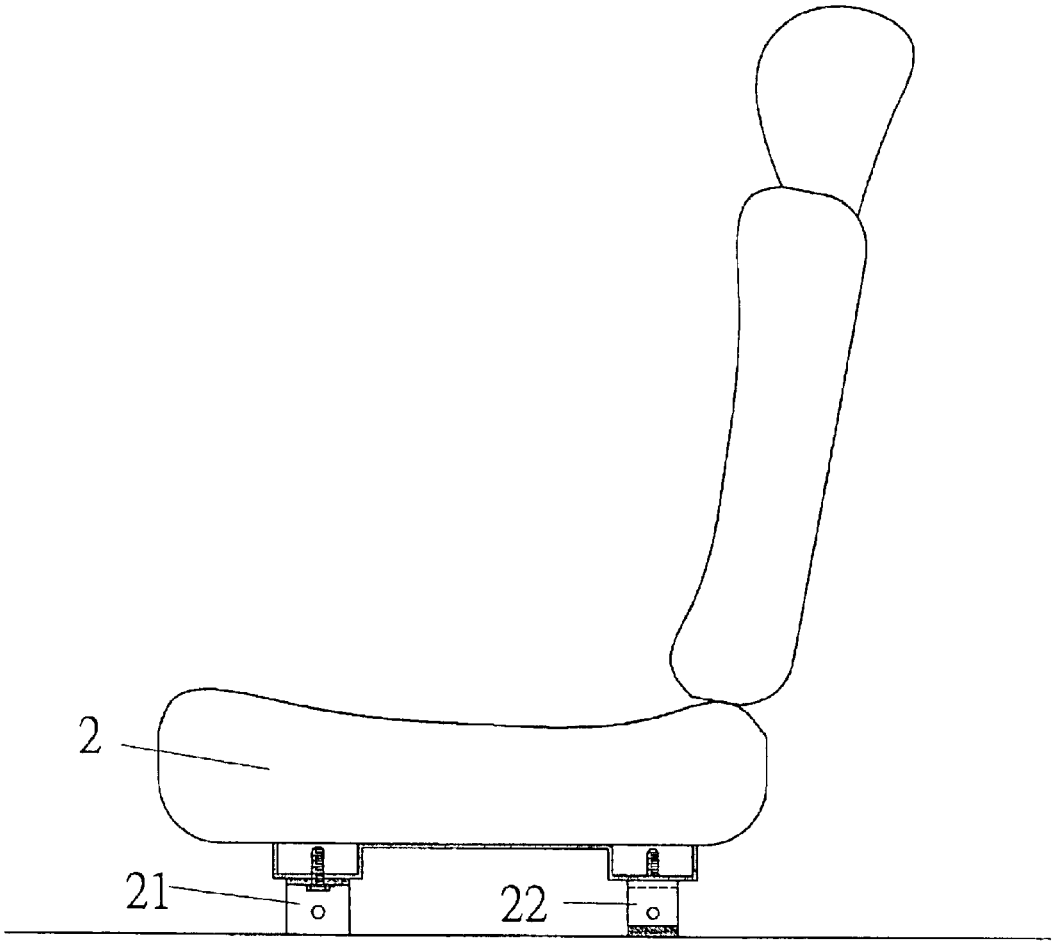
FIG. 6 is a cross-sectional view of the seat of the electric wheelchair of the present invention.
Figure 7:
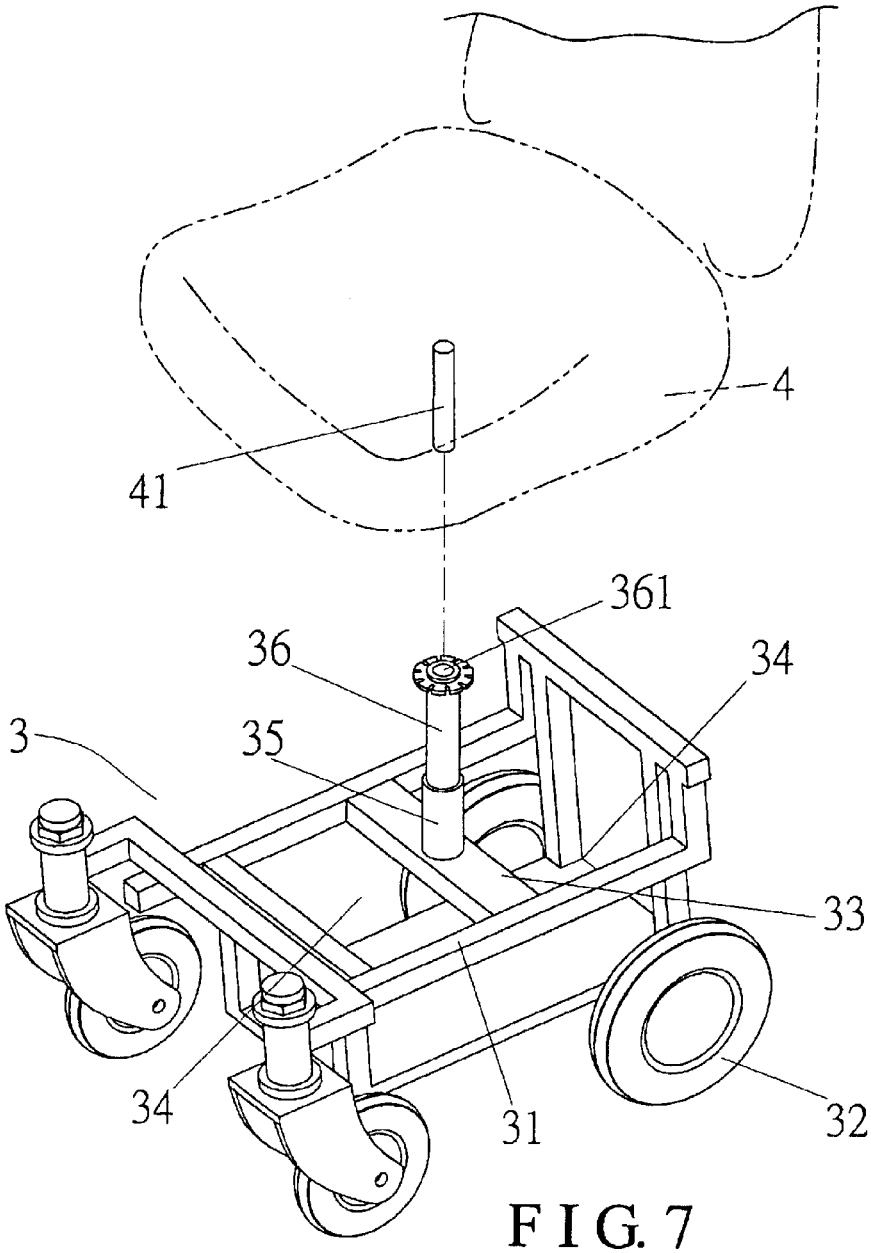
F I G. 7 (PRIOR ART)
FIG. 7 is an exploded perspective view of the conventional electric wheelchair.

2. When the wheelchair is transported in a car with the seat 2 and the main body 1 being separate, the seat can be put lower side down with four points, i.e. the engaging elements 21 and the fitting elements 22, supporting it in a stable position, as shown in FIG. 6.

3. The engaging elements 21 and the fitting elements 22 of the seat 2 can be moved to suitable positions for easy connection with corresponding locating parts 14 and fitting parts 15 therefore the wheelchair is convenient to use.

What is claimed is:

1. A fixing structure of a seat of an electric wheelchair, comprising a pair of juxtaposed front support rods projecting upwardly from a respective pair of front portions of a pair of lateral sides of a frame;

a pair of juxtaposed rear support rods projecting upwardly from a respective pair of rear portions of said lateral sides;

a pair of locating parts respectively secured to a top of each of said front support rods; each of said locating parts having two lateral portions formed with opposing guide trenches;

a pair of fitting parts respectively secured to a top of each of said rear support rods; each of said fitting parts having two lateral portions formed with outwardly-folded upper ends, and opposing through holes;

a pair of juxtaposed engaging elements secured to a front portion of a lower side of a seat; each engaging element having two lateral portions, a slide rod connected to the lateral portions at two ends, and an upper portion for connection with the seat; and a pair of juxtaposed fitting elements secured to a rear portion of the lower side of the seat; each fitting element having two lateral portions, opposed fitting holes on the lateral portions thereof, and upper portions extending from upper ends of the lateral portions for connection with the seat;

whereby allowing the seat to be secured to the frame by means of passing pins through the through holes as well as the fitting holes after the slide rods of the engaging elements are passed into the guide trenches of a corresponding locating part, and after the fitting holes of the fitting elements are aligned with the through holes of the fitting parts.

2. The fixing structure of claim 1, wherein the upper portions of the engaging elements are formed with an elongated hole, and threaded fixing elements are passed through the elongated holes and screwed into the seat.

3. The fixing structure of claim 1, wherein the upper portions of the fitting elements are formed with an elongated holes while threaded fixing elements are passed through the elongated holes and screwed into the seat.

* * * * *